US007338318B2

(12) United States Patent
Shen et al.

(10) Patent No.: US 7,338,318 B2
(45) Date of Patent: Mar. 4, 2008

(54) ELECTRICAL CONNECTOR WITH IMPROVED HOUSING

(75) Inventors: Guo-Jian Shen, Kunshan (CN); Chi Zhang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/593,331

(22) Filed: Nov. 6, 2006

(65) Prior Publication Data

US 2007/0105441 A1 May 10, 2007

(30) Foreign Application Priority Data

Nov. 4, 2005 (CN) ..... 20052007186.7

(51) Int. Cl.
*H01R 13/73* (2006.01)

(52) U.S. Cl. ..... 439/571; 439/660

(58) Field of Classification Search ..... 439/571, 439/660, 607–610, 405, 495, 79
See application file for complete search history.

(56) References Cited

U.S. PATENT DOCUMENTS 6,942,525 B2 * 9/2005 Olson et al. ..... 439/660
2004/0009684 A1 * 1/2004 Olson et al. ..... 439/79
2006/0121782 A1 * 6/2006 Shen et al. ..... 439/607
2007/0010125 A1 * 1/2007 Regnier ..... 439/495

FOREIGN PATENT DOCUMENTS

JP H10-125416 A 5/1998

* cited by examiner

*Primary Examiner*—J. F. Duverne
(74) *Attorney, Agent, or Firm*—Wei Te Chung

(57) ABSTRACT

An electrical connector for connecting a sheet-like connection member comprises an insulated housing (1) comprising a first sidewall (12), a second sidewall (13) parallel to and spaced from the first sidewall and a receiving cavity (10) between the first and second sidewalls, the first sidewall defining a plurality of receiving channels (14) arranged side-by-side to be in communication with the receiving cavity; and a plurality of conductive terminals (2, 3) disposed in the housing, each terminal comprising a contact beam (21, 31) received in the corresponding receiving channels and having a contact portion exposed to the receiving cavity for electrically contacting with the sheet-like connection member. The second sidewall defines a plurality of slugged grooves (17) in communication with the receiving cavity for providing a balanced force exerting on the sheet-like connection member. The slugged grooves and the receiving channels are staggered.

9 Claims, 4 Drawing Sheets

ELECTRICAL CONNECTOR WITH IMPROVED HOUSING

BACKGROUND OF THE INVENTION

1. Field of the Invention

The present invention relates to an electrical connector, and more particularly to an electrical connector for a sheet-like connection member such as a flexible printed circuit or a flexible flat cable.

2. Description of Related Art

Japanese Unexamined Patent Publication No. 10-125416 discloses a conventional connector adapted for connecting with a sheet-like connection member. The electrical connector includes an insulated housing having an elongated shape and a plurality of conductive terminals secured in the housing side-by-side. The housing comprises a pair of upstanding sidewalls spaced and parallel to each other and a receiving cavity between the sidewall for receiving the sheet-like connection member therein. One sidewall has a plurality of receiving channels in communication with the receiving cavity for receiving the conductive terminals. The conductive terminal has a contact portion received into the receiving channel and exposed to the receiving cavity for electrically contacting with the sheet-like connection member and a solder portion extending beyond the housing for connecting with a printed circuit board where the electrical connector is mounted. The other sidewall has a flat inner surface defined as a bearing surface for urging the sheet-like connection member to electrically contact with the terminals.

However, the housing is generally made of plastic resin, and having a complex shape as mentioned above is generally formed by an injection molding process. Because of the elongate shape of the second sidewall of the housing, it is often difficult for resin to flow into a mold smoothly upon injection molding, resulting in undesirable curve of the housing, thereby the bearing surface of the second sidewall hardly obtain a favorable planeness to exert a balanced force on the sheet-like connection member. Thus, some of terminals cannot stably and firmly contact with the sheet-like connection member.

Therefore, a new connector is desired to overcome the disadvantage of the prior art connector

SUMMARY OF THE INVENTION

An object of the present invention is to provide an electrical connector, which can achieve a stable and firm electrical connection between conductive terminal and a sheet-like connection member.

In order to achieve above-mentioned object, an electrical connector for connecting with a sheet-like connection member in accordance with the present invention is provided. The electrical connector comprises an insulated housing comprising a first sidewall, a second sidewall parallel to and spaced from the first sidewall and a receiving cavity between the first and second sidewalls, the first sidewall defining a plurality of receiving channels arranged side-by-side to be in communication with the receiving cavity; a plurality of conductive terminals disposed in the housing, each terminal comprising a contact beam received in the corresponding receiving channels and having a contact portion exposed to the receiving cavity for electrically contacting with the sheet-like connection member. The second sidewall defining a plurality of slugged grooves in communication with the receiving cavity for providing a balanced force exerting on the sheet-like connection member. The slugged grooves and the receiving channels are staggered.

Other objects, advantages and novel features of the present invention will become more apparent from the following detailed description of the present embodiment when taken in conjunction with the accompanying drawings.

DETAILED DESCRIPTION OF THE INVENTION

Figure 1:
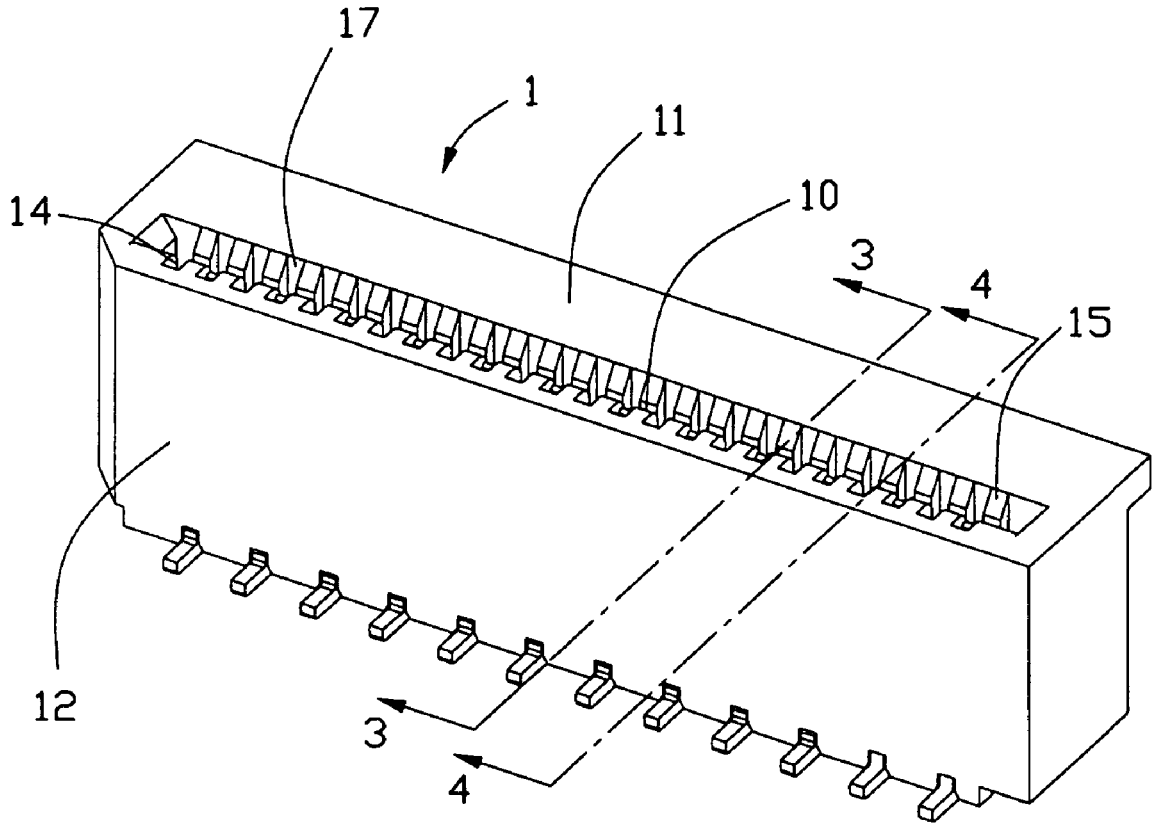
FIG. 1 is an assembled perspective view of an electrical connector in accordance with the present invention.

Reference will now be made to the drawing figures to describe the preferred embodiment of the present invention in detail.

Figure 2:
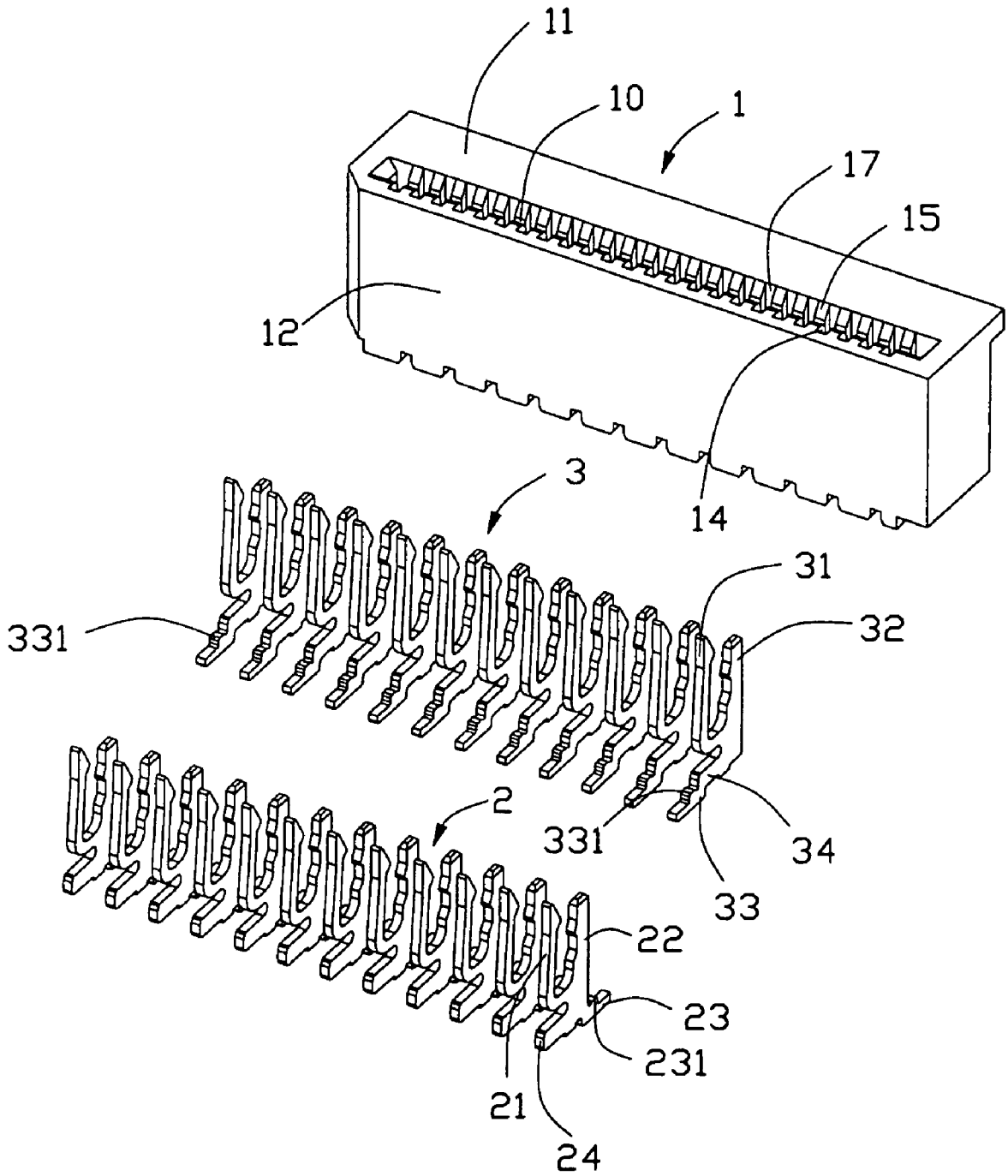
FIG. 2 is an exploded perspective view of the electrical connector shown in FIG. 1.

Referring to FIG. 2, an electrical connector in accordance with the present invention is provided. The electrical connector comprises an insulated housing 1 and a plurality of conductive terminals retained in the housing 1.

Referring to FIGS. 1 and 2, the housing 1 is substantially elongated shape and defines a mating surface 11 and a mounting surface opposite to the mating surface 11 and adjacent to a printed circuit board where the electrical connector is mounted. The housing 1 comprises four upstanding walls and a receiving cavity 10 surrounded by said four upstanding walls and opening to the mating surface 11 for receiving a sheet-like connection member such as a flexible printed circuit or a flexible flat cable. The upstanding walls consist of a first sidewall 12, a second sidewall 13 opposite and parallel to the first sidewall 12 and a pair of lateral walls connecting the first and second sidewalls 12, 13 together. The first sidewall 12 defines a plurality of receiving channels 14 extending from the mounting surface to the mating surface 10 for accommodating the conductive terminals and a plurality of partition portions formed between the receiving channels 14. The receiving channels 14 are in communication with the receiving cavity 10. The second sidewall 13 defines a plurality of slugged grooves 17 in communication with the receiving cavity 10 and extend from the mating surface 11 toward the mounting surface and a plurality of protrusions 15 formed between the slugged grooves 17 to be respectively opposite to the receiving channels 14. In other words, the receiving channels 14 and the slugged grooves 17 are staggered. Each of the protrusions 15 has a flat inner surface 150, and all these surfaces 150 are arranged in a substantially same plane to form a bearing surface of housing 1. Further referring to FIGS. 3 and 4, the second sidewall 13 further defines a plurality of the fixing channels 16 extending from the mounting surface toward the mating surface. The fixing channels 16 cooperate with the receiving channel 14 to retain the conductive terminals in the housing 1.

Figure 3:
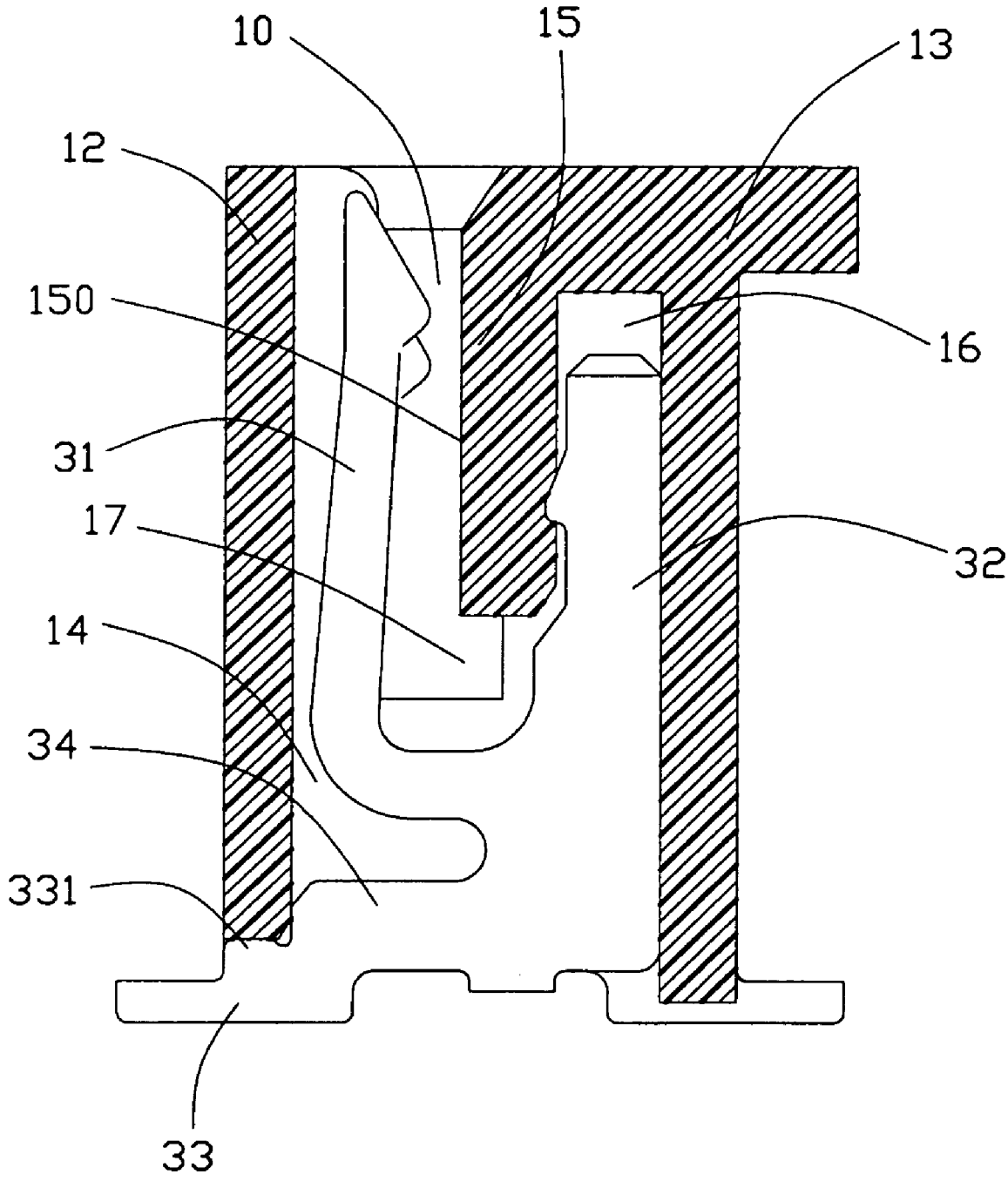
FIG. 3 is a cross-sectional view of FIG. 1 taken along line 3-3.
Figure 4:
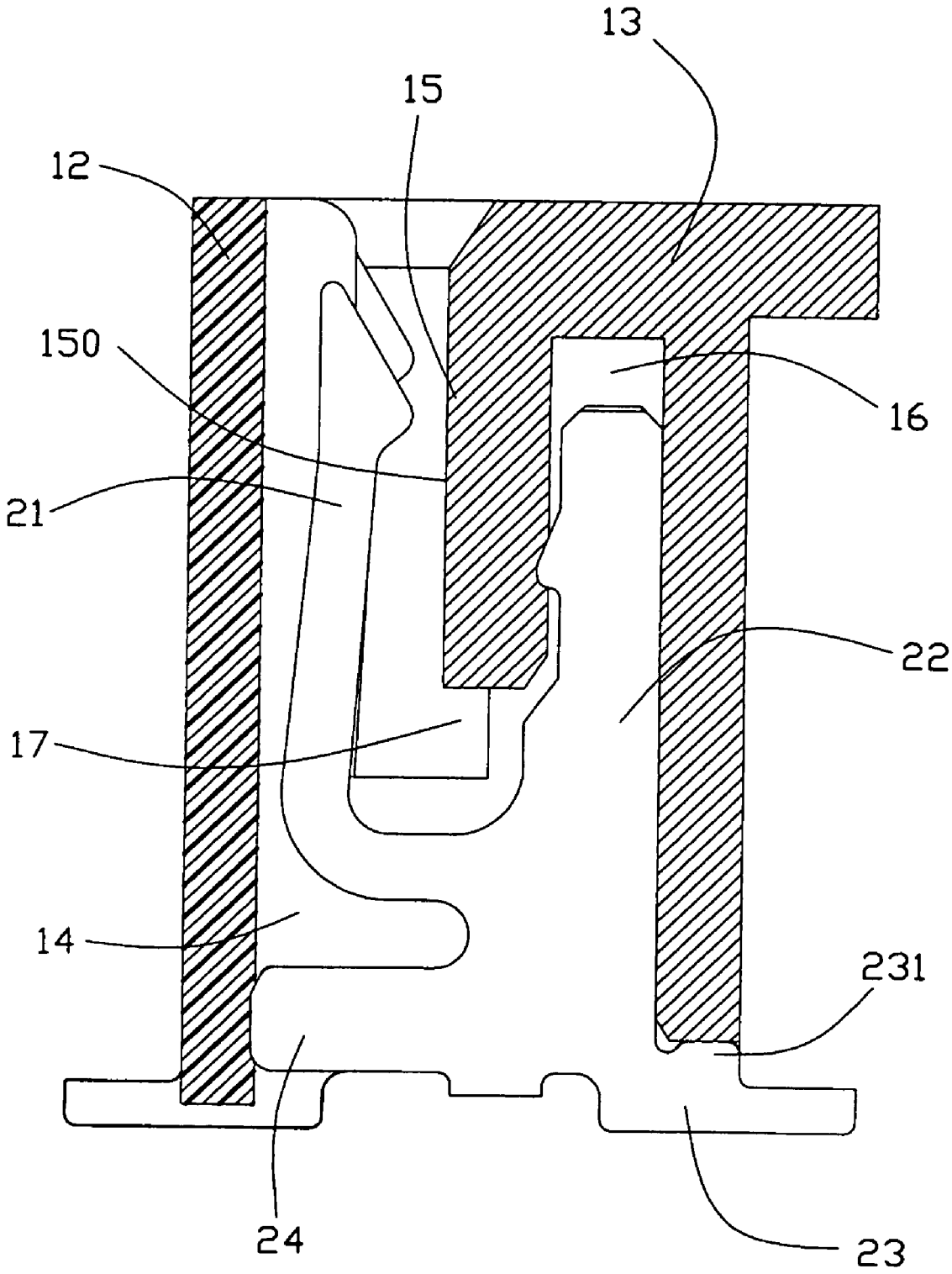
FIG. 4 is a cross-sectional view of FIG. 1 taken along line 4-4.

Referring to FIGS. 2, 3 and 4, the conductive terminals are divided into first terminals 2 and second terminals 3. Each of the first terminals 2 and second terminals 3 comprises a retaining beam 22, 32 and a contact beam 21, 31 branched from the retaining beam 22, 32 to extend substantially parallel to the contact beam 21, 31. Each of the contact beams 21, 31 received in the receiving channels 14 has a contact portion exposed to the receiving cavity 10 for electrically contacting with the sheet-like connection member.

The first terminal 2 further comprises a supporting beam 24 and a solder portion 23 both extending from the retaining beam 22 and perpendicularly to the contact beam 21. The supporting beam 24 is located below the contact beam 21 and has a free end abutting against an inner surface of the receiving channel 14. The solder portion 23 extends beyond the second sidewall 13 of the housing 1 and has a projection 231 confined by the second sidewall 13.

The second terminal 3 also further comprises a supporting beam 34 extending from the retaining beam 32 to abut against the inner surface of the receiving channels 14 and a solder portion 33 extending from the supporting beam 34 and beyond the first sidewall 11. The supporting beam 34 and the solder portion 33 also extend perpendicularly to the retaining beam 32 and are located below the contact beam 31. The solder portion 33 has a projection 331 adjacent to the supporting beam 34 and confined by the first sidewall 11.

When the first and second conductive terminals 2, 3 are alternately assembled into the housing 1 from the mounting surface, the contact beams 21, 31 are received in the receiving channels 14, the retaining beams 22, 32 are frictionally secured in the fixing channels 16 and the supporting beams 24, 34 all abut against the inner surfaces of the receiving channels 14. The solder portions 23 of the first terminals 2 are located adjacent to the first sidewall 11, while the solder portions 33 of the second terminals 3 extend opposite to the solder portions 23 to be located adjacent to the second sidewall 13. As a result, the distance between every two adjacent solder portions 23, 33 is large enough for the solder portions 23, 33 preferably being connecting to the printed circuit board.

When the sheet-like connection member is inserted to the receiving space 10 from the mating surface 10, one side of the sheet-like connection member electrically contact with the contact portions of the conductive terminals and the other side abuts against the bearing surface of the second sidewall 13. For the slugged grooves 17 are provided on the inner surface of the second sidewall 13, it is most possible for resin to smoothly flow into a material mold to achieve the housing without or at most having less undesirable curve during an injection molding process, and that the bearing surface formed by inner surfaces 150 of the projections 15 has a favorable planeness. Therefore, the bearing surface can provide a balanced force exerted on the sheet-like connection member so as to make the terminals all fully and stably contacting with the sheet-like connection member.

In this embodiment, the electrical connector is vertically mounted to the printed circuit board. Of course, for meeting some special requirements, the electrical connector also can be mounted in a right-angle type or the like.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for a sheet-like connection member, comprising:

an insulated housing comprising a first sidewall, a second sidewall parallel to and spaced from the first sidewall and a receiving cavity between the first and second sidewalls, the first sidewall defining a plurality of receiving channels arranged side-by-side to be in communication with the receiving cavity, the second sidewall defining a plurality of slugged grooves in communication with the receiving cavity; and a plurality of conductive terminals disposed in the housing, the terminal comprising a contact beam received in the corresponding receiving channel and having a contact portion exposed to the receiving cavity for electrically contacting with the sheet-like connection member, wherein the terminals consist of first terminals and second terminals, the first terminal has a solder portion adjacent to the second sidewall, and the second terminal has a solder portion extending opposite to the solder portion of the first terminal and adjacent to the first sidewall; wherein the first and second terminals are alternately mounted to the housing; wherein each of the first terminal and the second terminal has a retaining beam branching from the contact beam branches and a supporting beam extending from and perpendicular to the retaining beam to abut against the corresponding receiving channel; wherein the solder portion of the first terminal extends from the retaining beam and apart from the supporting beam of the first terminal, while the solder portion of the second terminal extends from the supporting beam of the second terminal.

2. The electrical connector as claimed in claim 1, wherein the slugged grooves extend along a same direction as the receiving channels.

3. The electrical connector as claimed in claim 1, wherein the slugged grooves and the receiving channels are staggered for achieving a stable connection between the terminals and the sheet-like connection member.

4. The electrical connector as claimed in claim 3, wherein the second sidewall further comprises a plurality of fixing channels corresponding to the receiving channels.

5. The electrical connector as claimed in claim 4, wherein the terminal comprises a retaining beam connected to the contact beam and secured in the corresponding fixing channels.

6. The electrical connector as claimed in claim 5, wherein the terminal further has a supporting beam extending from and perpendicularly to the retaining beam to abut against the corresponding receiving channel.

7. The electrical connector as claimed in claim 1, wherein the housing comprises a pair of lateral walls for connecting the first and second sidewalls.

8. An electrical connector for a sheet-like connection member, comprising:

an insulated housing comprising a first sidewall, a second sidewall parallel to and spaced from the first sidewall and a receiving cavity between the first and second sidewalls, the first sidewall defining a plurality of receiving channels arranged side-by-side to be in communication with the receiving cavity, the second sidewall defining a plurality of slugged grooves exposed on a top face of the housing and alternately arranged with the receiving channels in staggered manner along a longitudinal direction of the receiving cavity; and a plurality of conductive terminals disposed in the housing, the terminal comprising a contact beam received in the corresponding receiving channel and having a contact portion exposed to the receiving cavity for electrically contacting with the sheet-like connection member where the slugged groves receive no terminals.

9. The connector as claimed in claim 8, wherein the said slugged grooves communicate with the receiving cavity in a transverse direction perpendicular to said longitudinal direction.

* * * * *